United States Patent [19]

Takahashi

[11] Patent Number: 4,720,276

[45] Date of Patent: Jan. 19, 1988

[54] CLAMP TYPE CONTACT AND METHOD OF MANUFACTURE THEREOF

[75] Inventor: Toru Takahashi, Yokohama, Japan

[73] Assignee: Yamaichi Electric MFG. Co., Ltd., Tokyo, Japan

[21] Appl. No.: 841,458

[22] Filed: Mar. 19, 1986

[30] Foreign Application Priority Data

Mar. 25, 1985 [JP] Japan ..... 60-61525

[51] Int. Cl.[4] ..... H01R 11/22

[52] U.S. Cl. ..... 439/861; 439/856; 29/874

[58] Field of Search ..... 339/258 R, 258 P, 176 MP; 29/874; 439/682, 856, 861, 876

[56] References Cited

U.S. PATENT DOCUMENTS

| | | | |
|---|---|---|---|
| 3,486,163 | 12/1969 | DeVuyst et al. | 339/258 P |
| 3,555,497 | 1/1971 | Watanabe | 339/258 R |
| 4,140,361 | 2/1979 | Sochor | 339/176 M |
| 4,175,821 | 11/1979 | Hunter | 339/258 R |
| 4,241,970 | 12/1980 | Rider, Jr. et al. | 339/258 R |
| 4,257,668 | 3/1981 | Ellis, Jr. | 339/258 R |
| 4,534,611 | 8/1985 | Wohlfart | 339/258 R |
| 4,596,439 | 6/1986 | Ruehl et al. | 339/258 R |
| 4,598,972 | 7/1986 | Mullen, III et al. | 339/258 R |

FOREIGN PATENT DOCUMENTS 52-49978 11/1977 Japan .

*Primary Examiner*—Gil Weidenfeld
*Assistant Examiner*—Daniel W. Howell
*Attorney, Agent, or Firm*—Wenderoth, Lind & Ponack

[57] ABSTRACT

A clamp type contact has a first elongate contact piece which is punched out of a blank member having an upper thin piece and a lower thick piece disposed in a relative downward direction from a position immediately below the end of the upper thin piece so as to have a free end and a base end. A second elongate contact piece is defined by the remaining upper thin piece and has a free end corresponding to the end of the upper thin piece, a base end integrally joined to the base end of the first elongate contact piece, a base portion extending sidewise from the base end and a bent portion allowing the free end to face the free end of the first elongate contact piece. A male contact piece is formed on the lower thick piece of the blank member.

10 Claims, 18 Drawing Figures

CLAMP TYPE CONTACT AND METHOD OF MANUFACTURE THEREOF

BACKGROUND OF THE INVENTION

1. Field of the Invention

The present invention relates to a clamp type contact having a pair of elongate contact pieces adapted to clamp a terminal of an electronic component or electric connector therebetween and to a method of the manufacture of the clamp type contact.

2. Description of the Related Art

Generally, clamp type contacts used in a connector for connecting electronic appliances together are required to have good spring characteristics. A material having a high degree of toughness, such as phosphor bronze, is plated with gold and the result is used as a contact piece. Recently, there is an increasing demand for the miniaturization of contacts and the reduction of an accommodation space for contacts. Therefore, efforts have been made to obtain contact pieces having lengths effective to exhibit elastic displacement and to improve stock utilization as much as possible under the limited conditions by using a blank layout, resulting from the aforementioned demands for miniaturization and reduction.

Heretofore, a pair of opposed contact pieces of a clamp type contact have been formed either by punching a long blank member out of a sheet and bending the long blank member in a U-shaped or by punching two blank members connected through a connection portion out of a sheet and bending the blank members to rise from the connection portion, such as disclosed in Japanese Utility Model Publication No. SHO 52-49978. In either case, it is necessary not only to punch a blank member of at least a length corresponding to the total length of the contact pieces developed, but also to consider the bend allowance for the connection portion of the contact pieces in order to obtain sufficient effective lengths of the contact pieces. Since the reduction in length of the blank member to be punched out of a sheet has its own limit and since the bend allowance constitutes excess material, stock utilization cannot be greatly improved. Furthermore, since the opposed surfaces of the prior art contact pieces have relatively large widths, the recent demand for the miniaturization of contacts is not met.

When a clamp type contact has a pair of contact pieces of the same thickness for clamping a terminal therebetween, since the free ends of the contact pieces have similar frequency characteristics, there is a fair possibility of resonance phenomena occurring through the medium of the clamped terminal due to external vibrations, thereby giving rise to unstable contact between the terminal and the contact pieces.

SUMMARY OF THE INVENTION

The present invention has been proposed in order to eliminate the drawbacks of the conventional clamp type contact.

The main object of the present invention is to provide a clamp type contact efficiently manufactured from a blank member punched out of a sheet and having a limited length and a limited width, designed to facilitate highly enhanced stock utilization, simple in construction and capable of reliably clamping a terminal between contact pieces having a sufficient effective length necessary for exhibiting elasticity and also capable of suppressing resonance phenomena resulting from external vibrations tending to cause an unstable connection between the terminal and the contact pieces.

To attain the object described above, according to the present invention, there is provided a clamp type contact comprising a first elongate contact piece punched out of a blank member having an upper thin piece and a lower thick piece disposed in the downward direction from a position immediately below the end of the upper thin piece so as to have a free end and a base end; a second elongate contact piece constituted by the remaining upper thin piece and having a free end corresponding to the end of the upper thin piece, a base end joined integrally to the base end of the first elongate contact piece, a base portion extending sideways from and inclined relative to the base end thereof and a bent portion allowing the free end thereof to face the free end of the first elongate contact piece and a male contact piece constituted by the lower thick piece of the blank member.

The above and other objects, characteristic features and advantages of the present invention will become more apparent to those skilled in the art as the disclosure is made in the following description of preferred embodiments of the invention, as illustrated in the accompanying drawings.

DESCRIPTION OF THE PREFERRED EMBODIMENTS

Now, the present invention will be described in detail with reference to the illustrated embodiments.

Figure 3:
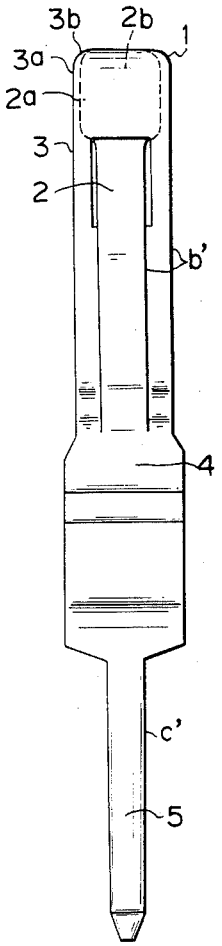
FIG. 3 is a left side view showing the clamp type contact of FIG. 1.
Figure 1:
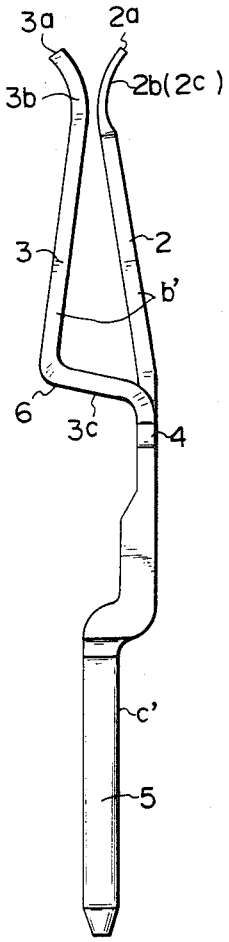
FIG. 1 is a front view illustrating one embodiment of the clamp type contact according to the present invention.
Figure 2:
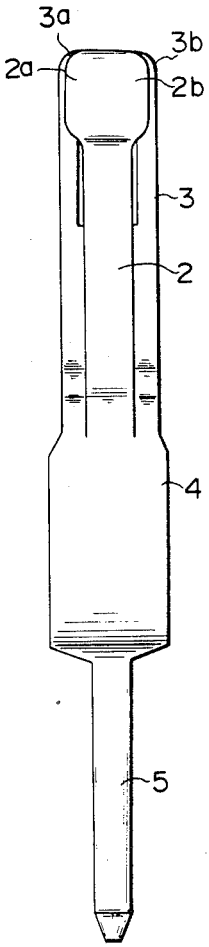
FIG. 2 is a right side view showing the clamp type contact of FIG. 1.
Figure 4A:
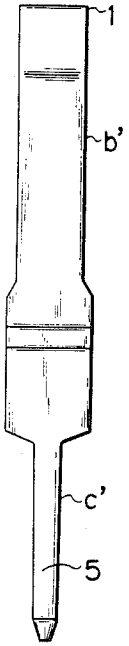
FIGS. 4A through 4G are explanatory views illustrating one embodiment of the method of manufacture of the clamp type contact of FIG. 1, FIG. 4A being a side view of a blank member, FIG. 4B being a front view of the blank member having an arcuate portion formed at one end thereof, FIG. 4C being a side view of the blank member having first and second elongate contact pieces formed by punching, FIG. 4D being a front view of the blank member having the second elongate contact piece bent to extend away from the first elongate contact piece, FIG. 4E being a front view of the blank member having the first elongate contact piece expanded at the free end thereof, FIG. 4F being a front view of the blank member having the first elongate contact piece provided with an arcuate portion, and FIG. 4G being a front view of the blank member having the second elongate contact piece bent to rise and face the first elongate contact piece.
Figure 4B:
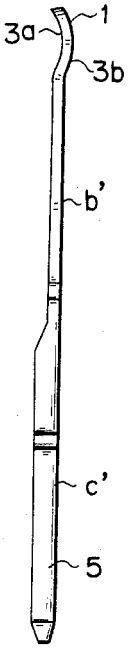
Figure 4C:
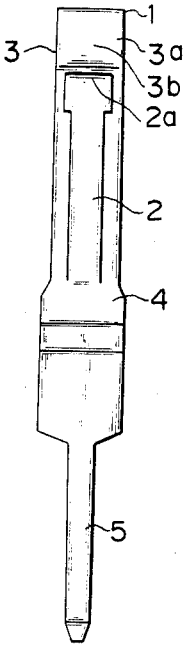
Figure 5:
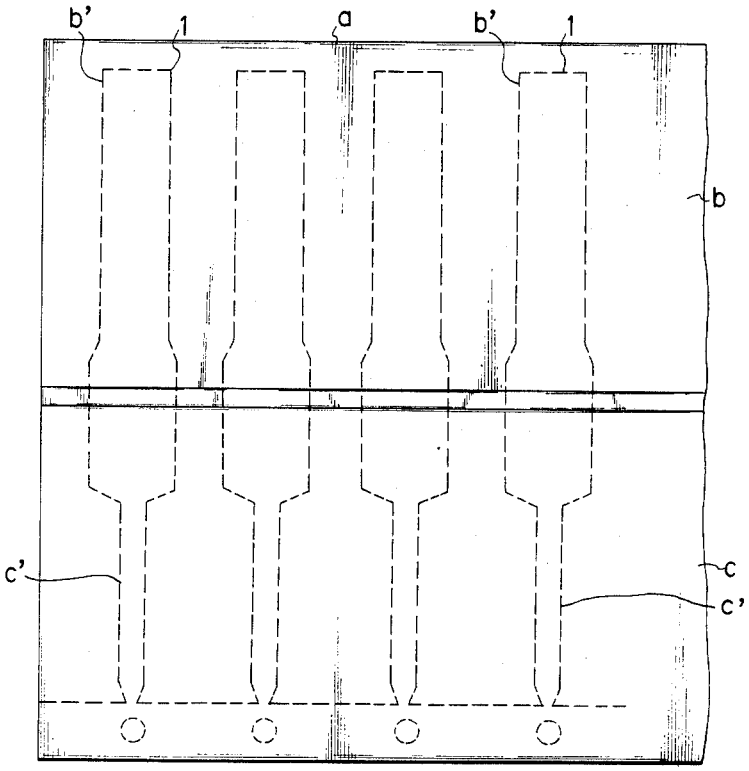
FIG. 5 is an explanatory side view illustrating a sheet in a state assumed before blank members are punched out of the sheet.
Figure 6:
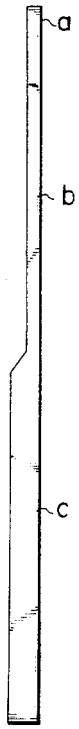
FIG. 6 is a front view showing the sheet of FIG. 5.

FIGS. 1 to 3 illustrate one embodiment of the clamp type contact according to the present invention and FIGS. 4A through 4G illustrate a method of manufacturing the clamp type contact. As illustrated in FIGS. 5 and 6, blank members 1 are punched out of a sheet a which has been subjected to a cutting treatment in its lengthwise direction so as to form a thin section b on the upper side thereof and a thick section c on the lower side thereof. Each of the blank members 1 has an upper thin piece b' exhibiting a high degree of elasticity and a thick piece c' exhibiting high rigidity and constituting a male contact piece 5, as illustrated in FIG. 4A. The upper portion of the thin piece b' of the blank member 1 is subjected to a bending treatment with a press to form an arcuate portion 3*b* as illustrated in FIG. 4B. The thin piece b' of the blank member 1 is punched at the center from a position immediately below the arcuate portion 3*b* in the downward direction with a joint portion 4 left existing, thereby forming a first elongate contact piece 2 and a second elongate contact piece 3 as illustrated in FIG. 4C. The first and second elongate contact pieces 2 and 3 have free ends 2*a* and 3*a* respectively and have their base ends connected to each other through the joint portion 4.

The formation of the arcuate portion 3*b* and the formation of the first and second elongate contact pieces 2 and 3 may be effected simultaneously with the punching of the blank members 1 out of the sheet a.

Figure 4D:
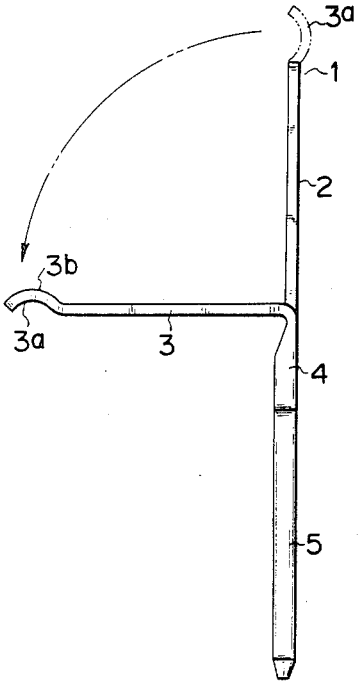
Figure 4E:
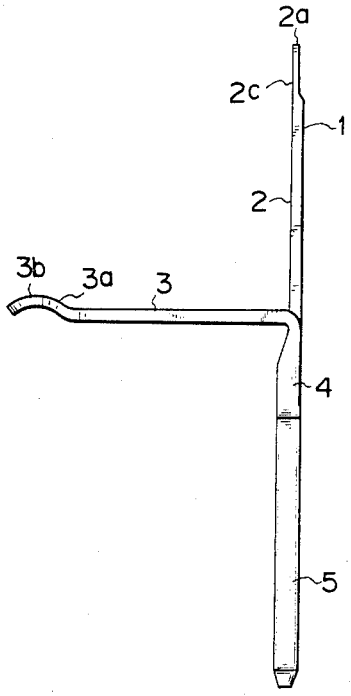
Figure 4F:
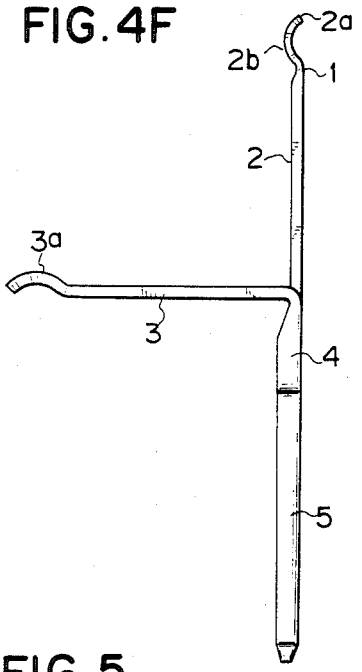
Figure 4G:
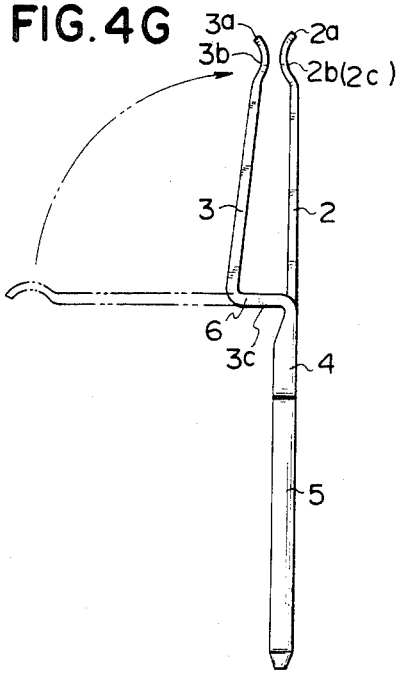

The second elongate contact piece 3 is then bent at its base end so as to extend sideways and apart from the first elongate contact piece 2 at a predetermined angle as illustrated in FIG. 4D. The first elongate contact piece 2 is then subjected to forging pressure at its free end 2*a* to form an expanded portion 2*c* having an increased surface area and a reduced thickness as illustrated in FIG. 4E and, as illustrated in FIG. 4F, the expanded portion 2*c* of the first elongate contact piece 2 is bent to form an arcuate portion 2*b*. The second elongate contact piece 3 extending sidewise is then bent so that a base portion 3*c* thereof remains extended sidewise and a rising portion thereof assumes a substantially L-shape having a bent portion 6 and so that the bottoms of the arcuate portions 2*b* and 3*b* of the first and second elongate contact pieces face each other, as illustrated in FIG. 4G.

Thus, the clamp type contact according to the present invention is manufactured. A terminal of an electronic component such as an IC lead, or a terminal of an electric connector (not shown) is clamped between the arcuate portions 2*b* and 3*b* of the first and second elongate contact pieces 2 and 3 of the clamp type contact as illustrated in FIGS. 1 to 3. The joint portion 4 of this clamp type contact can serve as a fulcrum permitting the first and second elongate contact pieces 2 and 3 to be elastically shifted. In place of the arcuate portions 2*b* and 3*b*, the free ends 2*a* and 3*a* may be formed into a substantially L-shape or any other projecting shape. Since forging pressure is subjected to the free end 2*a* of the first elongate contact piece 2, as described above, the surface area of the arcuate portion 2*b* can be made as approximate to the surface area of the arcuate portion of the second elongate contact piece 3 as is possible, and thus contact of a terminal clamped between the arcuate portions 2*b* and 3*b* is ensured.

Figure 9:
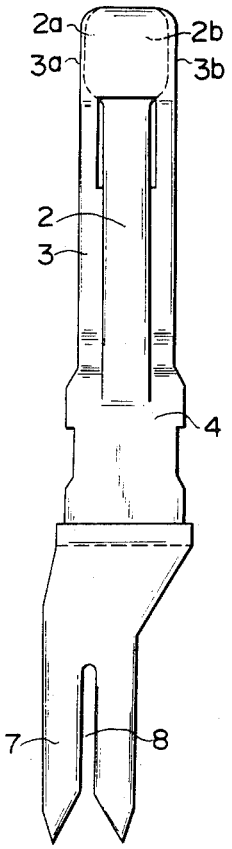
FIG. 9 is a left side view showing the clamp type contact of FIG. 7.
Figure 7:
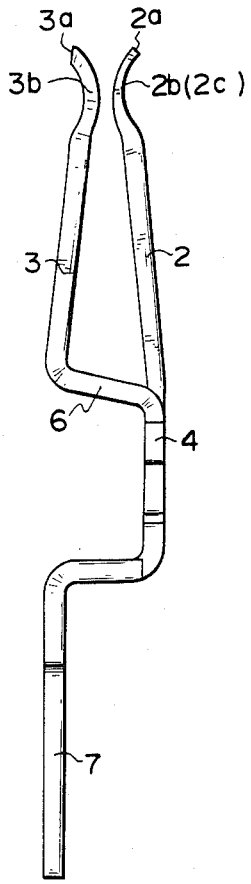
FIG. 7 is a front view illustrating another embodiment of the clamp type contact according to the present invention.
Figure 8:
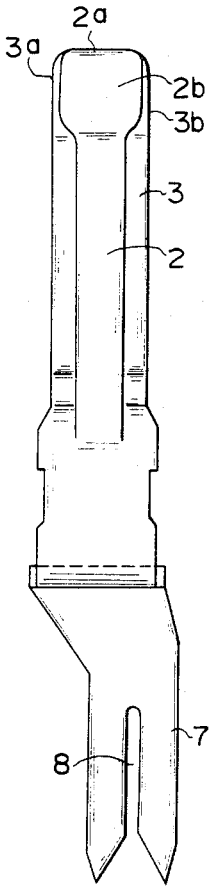
FIG. 8 is a right side view showing the clamp type contact of FIG. 7.

FIGS. 7 to 9 illustrate another embodiment of the clamp type contact according to the present invention. In this embodiment, the lower end of the clamp type contact is formed into a pressure-connection contact piece 7, instead of a male contact piece 5 as in the first embodiment, having a cable press-in groove 8 perpendicular to the space between the first and second elongate contact pieces 2 and 3. This embodiment is identical in structure, other than the lower end of the clamp type contact, to the preceding embodiment and, therefore, the detailed description of this embodiment has been omitted.

Figure 10:
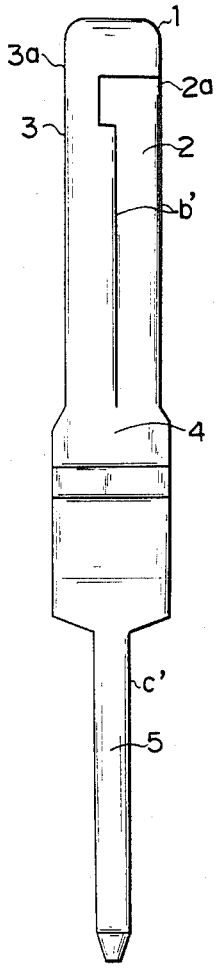
FIG. 10 is a left side view illustrating still another embodiment of the clamp type contact according to the present invention in a semifinished state.
Figure 11:
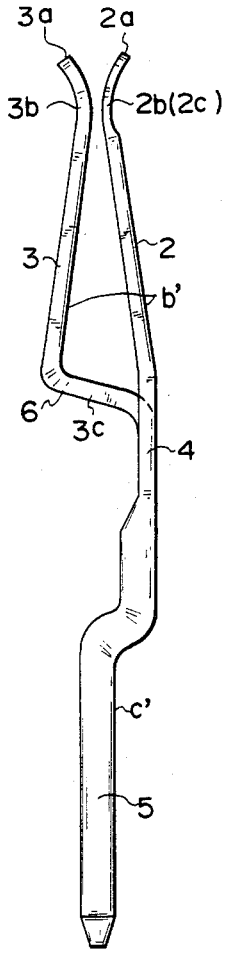
FIG. 11 is a front view showing the clamp type contact of FIG. 10 in the finished state.
Figure 12:
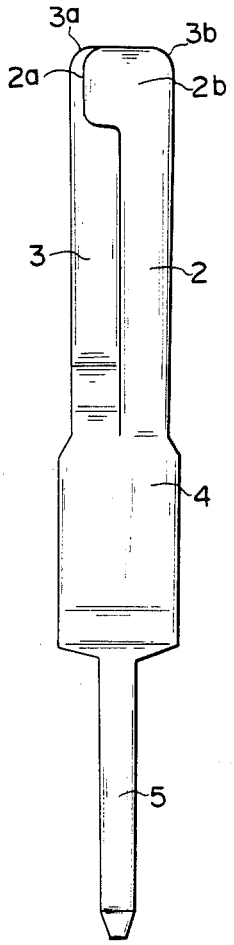
FIG. 12 is a right side view showing the clamp type contact of FIG. 11.

FIGS. 10 to 12 illustrate still another embodiment of the clamp type contact according to the present invention. This embodiment is different from the preceding embodiments wherein the blank member 1 is punched at the center thereof to form the first elongate contact piece 2 hollowed out of the center of the blank member 1 and the second elongate contact piece 3 is bifurcated, in that this embodiment has first and second elongate contact pieces 2 and 3 formed by punching a blank member 1 at one side thereof from a portion thereof immediately below the free end 3*a* as illustrated in FIG. 10 showing a semifinished product. The semifinished product is processed into a clamp type contact in the same manner as that illustrated in FIGS. 4D through 4G. In this embodiment, therefore, the second elongate contact piece 3 exhibits higher strength than the bifurcated second elongate contact piece 3 of the preceding embodiments.

According to the present invention, as described above, it is possible to efficiently manufacture, from blank members punched out of a sheet to having a limited length and a limited width and with highly enhanced stock utilization, clamp type contacts having a simple construction having a pair of first and second elongate contact pieces which extend in parallel, have their respective free ends facing each other and their respective base ends joined together, and also have sufficient effective lengths necessary for exhibiting elasticity and that terminals of an electronic component or electric connector can be elastically clamped between the free ends thereof with a high degree of reliability.

Therefore, the present invention can meet an increasing demand for the miniaturization of clamp type contacts. Furthermore, since the free ends of the pair of first and second elongate contact pieces of the present clamp type contact facing each other have different thicknesses, it is possible to suppress the resonance phenomena resulting from external vibrations and tending to give rise to an unstable connection between the terminals and contact pieces.

What is claimed is:

1. A clamp type contact comprising:

a thin upper end at which first and second elongate contact pieces are defined each of which extend from a common base end at an end of said thin upper end to respective free ends thereof, said second elongate contact piece having a base portion extending from said base end at a predetermined angle thereto and a bent portion extending from said base portion to said respective free end thereof, the respective free end of the second elongate contact member facing the respective free end of the first elongate contact member, and the free end of said first elongate contact piece comprising an expanded portion having a surface area that is increased and a thickness that is reduced with respect to the portion of the first elongate contact piece from which the free end thereof extends.

2. A clamp type contact according to claim 1, wherein the free ends of said first elongate contact piece and said second elongate contact piece have an arcuate shape with bottom portions thereof facing each other.

3. A clamp type contact according to claim 1, wherein said first elongate contact piece extends from said thin upper end at the center thereof, and said second elongate contact piece is bifurcated.

4. A clamp type contact according to claim 1, wherein said first elongate contact piece extends from said thin upper end at one side thereof.

5. A clamp type contact according to claim 1, and further comprising a lower thick end extending from the said thin upper end at a position adjacent said common base end of said first and said second elongate contact pieces, said lower thick end comprising a male contact piece having spaced apart connection contact pieces between which a cable press-in groove is defined, said connection contact pieces disposed in a common plane that is perpendicular to a common plane in which said first and said second elongate contact pieces extend.

6. A method of manufacturing clamp type contacts, comprising the steps of:

(a) preparing a sheet having been subjected to cutting treatment in its lengthwise direction so as to form an upper thin section and a lower thick section, (b) punching a plurality of blank members out of said sheet so that each of said blank members has an upper thin piece and a lower thick piece which constitutes a male contact piece, (c) subjecting the end of the upper thin piece of said blank member to a bending treatment with a press to form an arcuate portion, (d) punching the upper thin piece of said blank member from a position immediately below said arcuate portion in a downward direction with a joint portion left existing to form a first elongate contact piece having a free end and a second elongate contact piece having a free end corresponding to said arcuate portion and a base end integrally joined to the base end of said first elongate contact piece through said joint portion, (e) bending said second elongate contact piece at the base end thereof so as to extend sideways and apart from said first elongate contact piece at a predetermined angle thereto, (f) subjecting the free end of said first elongate contact piece to forging pressure to form an expanded portion having an increased surface area and a reduced thickness, (g) bending said expanded portion of said first elongate contact piece to form an arcuate portion, and (h) bending said second elongate contact piece extending sideways to form a substantially L-shape bent portion with bottoms of said arcuate portions of said first elongate contact piece and said second elongate contact piece facing each other.

7. A method according to claim 6, wherein the steps (b), (c) and (d) are carried out at the same time.

8. A method according to claim 6, wherein said first elongate contact piece is punched out of the upper thin piece of said blank member at the center thereof, and said second elongate contact piece is bifurcated.

9. A method according to claim 6, wherein said first elongate contact piece is punched out of the upper thin piece of said blank member at one side thereof.

10. A method according to claim 6, and further comprising the step of forming the male contact piece into pressure-connection contact pieces having a cable press-in groove extending therebetween in a direction perpendicular to a direction in which a space extends between said first elongate contact piece and said second elongate contact piece.

* * * * *